US006275568B1

(12) United States Patent
Prins et al.

(10) Patent No.: US 6,275,568 B1
(45) Date of Patent: Aug. 14, 2001

(54) X-RAY EXAMINATION APPARATUS

(75) Inventors: Menno W. J. Prins; Johannus W. Weekamp; Jacobus B. Giesbers; Michel C. J. M. Vissenberg; Coenraad A. A. M. Vugts, all of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/469,884

(22) Filed: Dec. 22, 1999

(30) Foreign Application Priority Data

Dec. 22, 1998 (EP) ..... 98204385

(51) Int. Cl.[7] ..... G21K 3/00
(52) U.S. Cl. ..... 378/158; 378/156; 378/157
(58) Field of Search ..... 378/156, 157, 378/158

(56) References Cited

U.S. PATENT DOCUMENTS 5,425,179 6/1995 Nickel et al. ..... 33/366
5,703,484 12/1997 Bieberdorf et al. ..... 324/207.22
6,188,749 * 2/2001 Schiller et al. ..... 378/158

FOREIGN PATENT DOCUMENTS 2599886 12/1987 (FR) ..... G21K/4/00
2273356 6/1994 (GB) ..... G01C/9/24
9613040 5/1996 (WO) ..... G21K/3/00

* cited by examiner

*Primary Examiner*—Robert H. Kim
*Assistant Examiner*—Courtney Thomas
(74) *Attorney, Agent, or Firm*—John F. Vodopia

(57) ABSTRACT

The invention relates to an X-ray apparatus which includes an adjustable X-ray filter. In order to adjust an intensity profile of the X-ray beam, an X-ray absorbing liquid is transported to filter elements of the X-ray filter. Such transport is susceptible to gravitational forces which lead to an irregular hydrostatic pressure distribution in the X-ray filter. In order to reduce the effects of the gravitational forces on the transport of the X-ray absorbing liquid, the duct connecting the filter elements to the reservoir is subdivided into sub-ducts and the reservoir is subdivided into chambers, each chamber being connected to at least one sub-duct. The X-ray apparatus also includes means for keeping the sub-ducts aligned with a horizontal plane.

12 Claims, 4 Drawing Sheets

X-RAY EXAMINATION APPARATUS

BACKGROUND OF THE INVENTION

The invention relates to an X-ray examination apparatus for forming X-ray images of an object, which apparatus includes an X-ray source for generating an X-ray beam, an X-ray filter which is provided with filter elements which are arranged to contain an adjustable quantity of X-ray absorbing liquid in order to adjust an intensity profile on an object, and with a supply duct for connecting the filter elements to a reservoir for the X-ray absorbing liquid, an X-ray detector for receiving a part of the X-ray beam, having traversed the object, in order to detect an X-ray image.

The invention also relates to an X-ray filter for use in an X-ray examination apparatus of this kind.

An X-ray examination apparatus of the kind set forth is known from international patent application WO 96/13040. The X-ray filter in the known X-ray examination apparatus is used to limit the dynamic range of an X-ray image of an object which is formed on the X-ray detector, for example a human or animal body to be examined. The filter elements of the X-ray filter are constructed as capillary tubes, one end of which communicates with the X-ray absorbing liquid present in the reservoir. The X-ray absorbing liquid contains, for example aqueous solutions of salts of, for example lead, cesium or tungsten. The quantity of X-ray absorbing liquid can be adjusted by way of electrowetting. To this end, the tubes are provided with an electrical conductor which serves as an electrode. Furthermore, an electrically insulating coating layer is provided on the electrode. In the context of the present application the term "electrowetting" is to be understood to mean an adjustable adhesion of the X-ray absorbing liquid to the electrically insulating coating layer, which adhesion is dependent inter alia on the value of an electric voltage applied across the electrically conductive layer and the X-ray absorbing liquid. As a result, the filling of each of the capillary tubes can be adjusted by variation of the electric voltage value so that an X-ray absorption profile of the X-ray filter is adjusted within a short period of time, for example 0.4 seconds.

In order to form an image of the desired organs in the object, the X-ray detector is arranged opposite the X-ray source on a first axis with a part of the object to be imaged, and the X-ray filter is situated on this first axis between the X-ray source and the object, an entrance face of the X-ray filter then being oriented transversely of the first axis.

The arrangement is functional if the first axis is directed vertically during operation. It is a drawback of the known X-ray examination apparatus that, when the first axis is directed horizontally, the adjustment of the quantity of X-ray absorbing liquid in the capillary tubes is susceptible to an uneven hydrostatic pressure distribution in the supply duct.

SUMMARY OF THE INVENTION

It is an object of the invention to provide an X-ray examination apparatus in which the susceptibility of the adjustment of the quantity of X-ray absorbing liquid in the capillary tubes to the uneven hydrostatic pressure distribution is reduced. To this end, an X-ray examination apparatus according to the invention is characterized in that the supply duct includes sub-ducts, and that each of the sub-ducts connects at least one of the filter elements to the reservoir. When the X-ray filter is arranged in the X-ray examination apparatus in such a manner that, a longitudinal axis of the sub-channels is directed horizontally during operation, the uneven hydrostatic pressure distribution, which is due to the fact that the capillary ducts are situated above one another in this condition, is counteracted by the taking up of the hydrostatic pressure by partitions between the sub-ducts. Attractive embodiments of the X-ray examination apparatus are defined in the dependent claims.

A special embodiment of the invention is characterized in that the sub-ducts are arranged so as to extend parallel to one another. Orienting all sub-ducts so that they extend substantially in parallel minimizes the uneven pressure distribution in the sub-ducts when the sub-ducts are directed horizontally.

A further embodiment of the invention is characterized in that the X-ray examination apparatus is provided with adjusting means for keeping the X-ray source, the X-ray filter and the detector oriented along a first axis and for adjusting an orientation of the first axis relative to a horizontal plane, the X-ray examination apparatus also including means for rotating the X-ray filter about the first axis. As a result of the addition of such adjusting means, a projection image of the object can be formed at different angles. Rotation of the X-ray filter about the first axis enables the sub-ducts to be oriented in such a manner that the gravitational force component along the sub-ducts amounts to substantially zero and the uneven pressure distribution in a sub-duct is minimum. The rotation of the X-ray filter can be realized by arranging a rotatable X-ray filter in a collimator, or by mounting the collimator so as to be rotatable about the first axis in the X-ray examination apparatus.

A further embodiment of the X-ray examination apparatus according to the invention is characterized in that the X-ray examination apparatus is provided with means for generating a signal which represents an angle of inclination between a longitudinal axis of the sub-ducts and a horizontal plane. As a result of these steps, an operator or an automatic control system can orient the longitudinal axis of the sub-ducts in dependence on the signal upon a change of orientation of the first axis.

A further embodiment according to the invention is characterized in that the means for generating the signal representing the angle of inclination include a roll-independent inclinometer. Such an inclinometer is insensitive to a rolling motion about the axis with to respect to which the inclination relative to the horizontal plane is determined. Such an inclinometer can be used for an arbitrary orientation of the first axis.

Another embodiment according to the invention is characterized in that the means for rotating the X-ray filter include an electrically controllable drive and that the X-ray examination apparatus is provided with control means which are arranged to generate control signals for the electrically controllable drive in order to orient the sub-ducts horizontally in dependence on the signal representing the angle of inclination.

A further embodiment according to the invention is characterized in that the X-ray filter contains the reservoir which is arranged outside the X-ray beam to be generated, the reservoir containing chambers and each chamber being connected to at least one of the sub-ducts. In order to avoid the necessity of long supply and discharge ducts between the reservoir and the sub-ducts, the reservoir can be mounted in the X-ray filter. In order to counteract an uneven hydrostatic pressure distribution in the sub-ducts, the reservoir is subdivided into chambers, each chamber being connected to at least one sub-duct. The number of sub-ducts connected to a chamber of the reservoir amounts to, for example, three in practice.

A further embodiment of the X-ray examination apparatus according to the invention is characterized in that the X-ray examination apparatus is provided with means for generating a control signal whereby the adjustable quantity of X-ray absorbing liquid in the filter elements is adjusted.

A further embodiment of the X-ray examination apparatus according to the invention is characterized in that the X-ray examination apparatus is provided with means for generating a compensation signal which is dependent on the orientation of the X-ray filter, and with means for correcting the control signal by way of the compensation signal.

It is thus possible in practice to compensate hydrostatic pressure differences which are due to several capillary tubes being situated above one another. A maximum magnitude of such a compensation voltage can be determined experimentally. The value to be adjusted for the compensation voltage is dependent on the orientation of the X-ray filter. An X-ray filter according to the invention is defined in claim 11.

These and other aspects of the invention are apparent from and will be elucidated by way of example, with reference to the embodiments described hereinafter and the accompanying drawing.

DETAILED DESCRIPTION OF THE PREFERRED EMBODIMENTS

Figure 1:
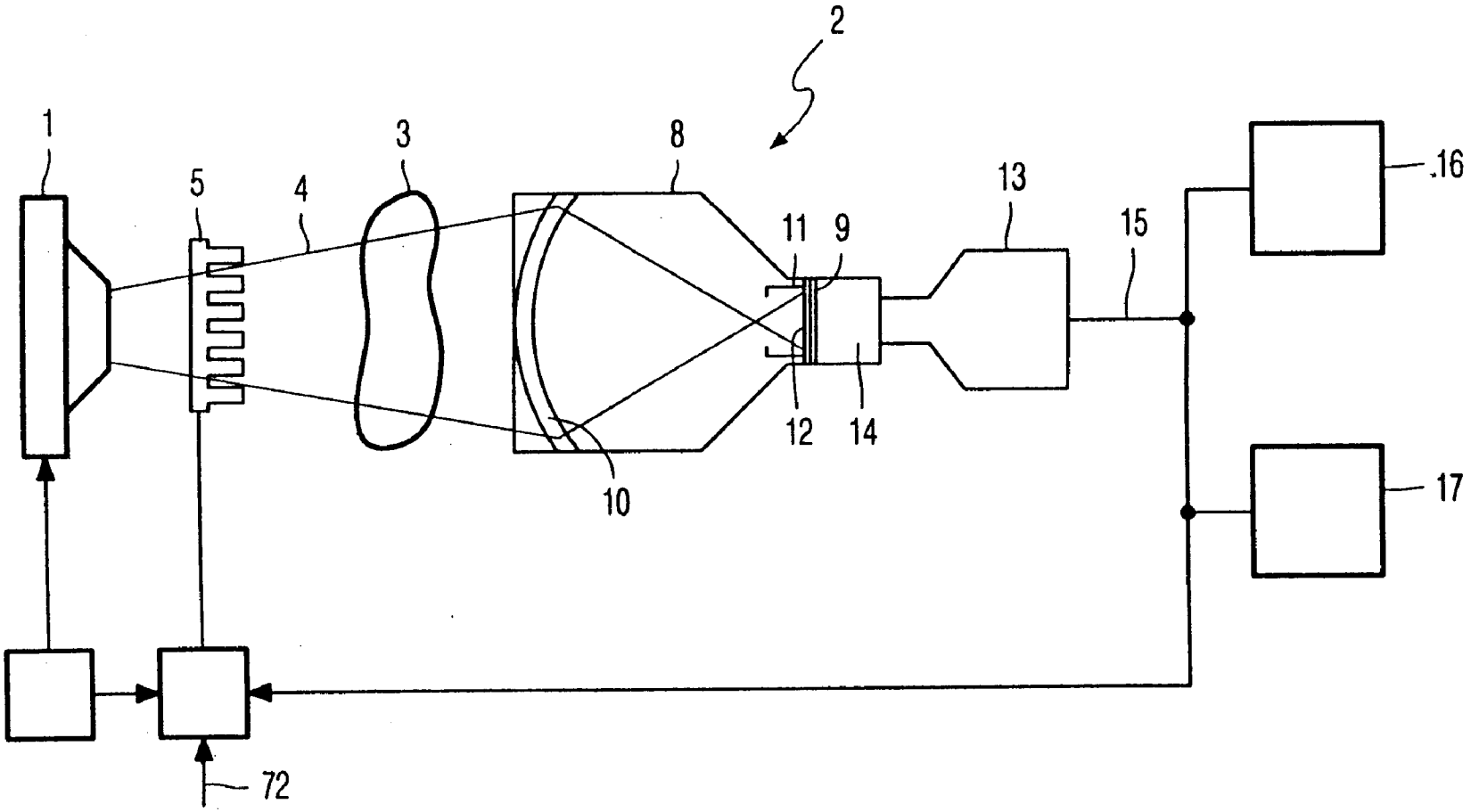
FIG. 1 shows an X-ray examination apparatus.

FIG. 1 shows an example of an X-ray examination apparatus. An X-ray source 1 emits an X-ray beam 4 for irradiating an object 3. Differences in the absorption of X-rays in the object 3, for example a patient to be radiologically examined, lead to the formation of an X-ray image on an X-ray-sensitive surface 17 of the X-ray detector 2 which is arranged so as to face the X-ray source 1. The X-ray source 2 is connected to a high voltage and control unit 6. The X-ray detector 2 is provided, for example with an image intensifier pick-up chain which includes an X-ray image intensifier 8 for converting an X-ray image into an optical image on an exit window 9, and a video camera 13 for picking up the optical image. An entrance screen 10 acts as the X-ray-sensitive surface which converts incident X-rays into an electron beam which is imaged on the exit window 9 by way of an electron-optical system 11. The incident electrons generate the optical image by way of a phosphor layer 12 on the exit window. The video camera 13 is optically coupled to the X-ray image intensifier 8 by way of an optical coupling. The optical coupling includes, for example a lens system or an optical fiber coupling 14. The video camera derives an electronic image signal 15 from the optical image and applies the electronic image signal to a monitor 16 in order to visualize the image information contained in the X-ray image. The electronic image signal 15 can also be applied, for example to an image processing unit 17 for further processing. In order to attenuate the X-ray beam 4 locally so as to adjust a two-dimensional intensity profile, an X-ray filter 4 is arranged in the X-ray beam 4 between the X-ray source 1 and the object 3. The X-ray filter includes a large number of filter elements (not shown). Furthermore, a filter element preferably includes a capillary tube. The capillary tubes communicate with a reservoir (not shown in FIG. 1) by way of a first opening, which reservoir contains an X-ray absorbing liquid. The X-ray absorptivity can be adjusted by applying, preferably by means of an adjusting unit 7, electric voltages across the inner side of the capillary tubes and the X-ray absorbing liquid. This is because the adhesion of the X-ray absorbing liquid to the inner side of the capillary tubes is dependent on the electric voltage applied across the inner side of the capillary tubes and the X-ray absorbing liquid. In dependence on the electric voltage applied across the individual capillary tubes (not shown) and the X-ray absorbing liquid, the capillary tubes are filled with a given quantity of X-ray absorbing liquid. The number of capillary tubes of the X-ray filter amounts to, for example 128×128.

Figure 2:
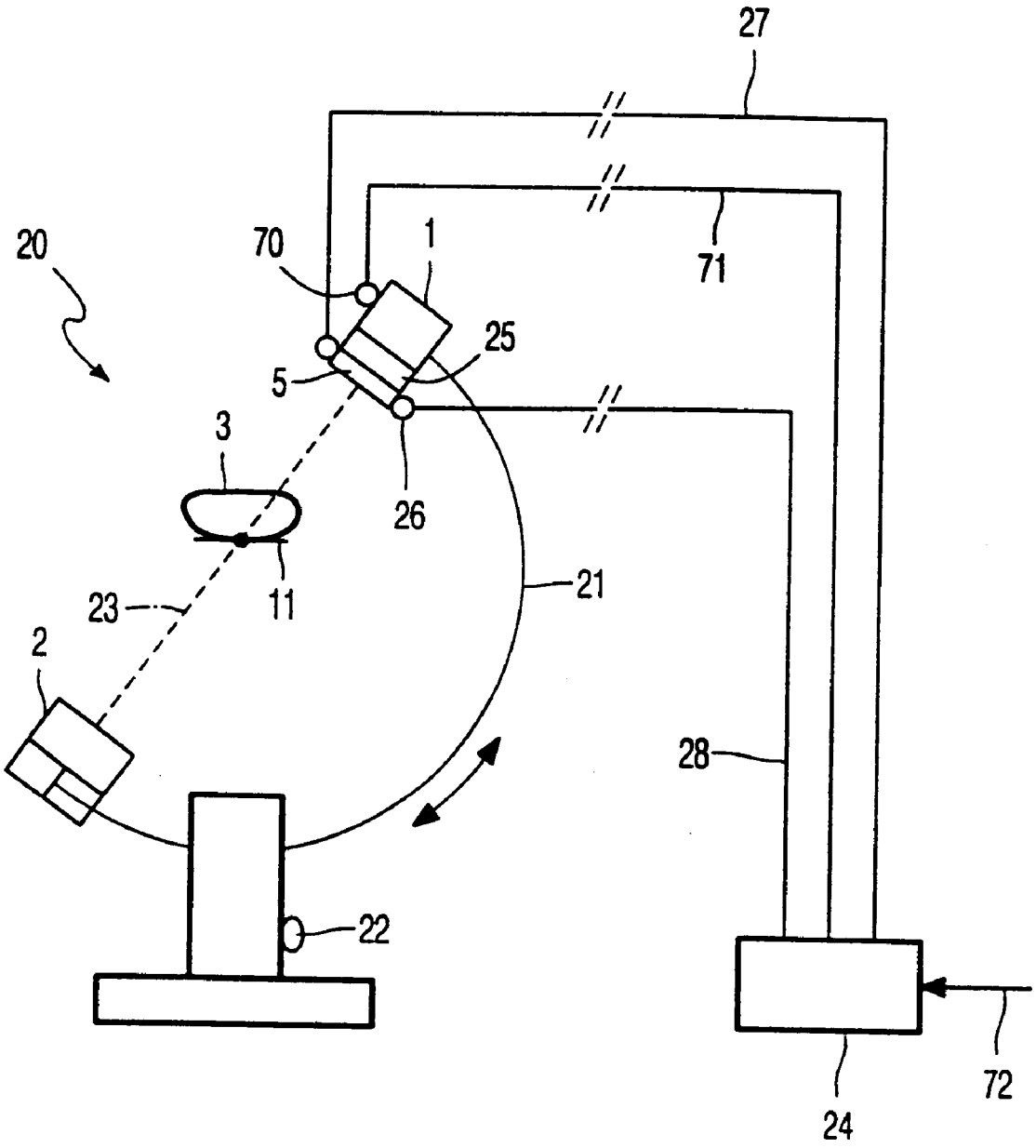
FIG. 2 shows a C-arm.

In order to form a projection image of the object 3, the X-ray examination apparatus is preferably provided, as shown in FIG. 2, with adjusting means 22 for keeping the X-ray source 1, the X-ray filter 5 and the X-ray detector 2 oriented along a first axis 23 and for adjusting an orientation of the first axis relative to the horizontal plane. A projection image of the object 3, to be adjusted in advance, is thus obtained on the X-ray detector 2. Means of this kind include, for example a C-arm with control means. FIG. 2 shows such a C-arm with adjusting means 22. The X-ray examination apparatus is also provided with a collimator 25 in which, for example the X-ray filter 5 is mounted so as to be rotatable about the first axis 23. Instead of mounting the X-ray filter 5 so as to be rotatable in the collimator 25, the X-ray filter may also be mounted so as to be fixed in the collimator and the collimator can be mounted so as to be rotatable in the X-ray examination apparatus, so that the collimator and the X-ray filter are capable of rotation together about the first axis 23. The X-ray examination apparatus is also provided with electrically controllable drives, for example an electric motor and a mechanical transmission 26 for rotation of the X-ray filter 5 about the first axis 23. The electrically controllable drive 26 is connected to a control unit 24, for example a microcomputer.

According to the invention the supply duct of the X-ray filter 5 includes subducts, each of which connects several filter elements to a reservoir which is preferably integrated in the X-ray filter, the sub-ducts preferably being arranged parallel to one another. The location of such sub-ducts in the X-ray filter 5 will be described in detail hereinafter with reference to FIG. 3 and FIG. 4.

Figure 3:
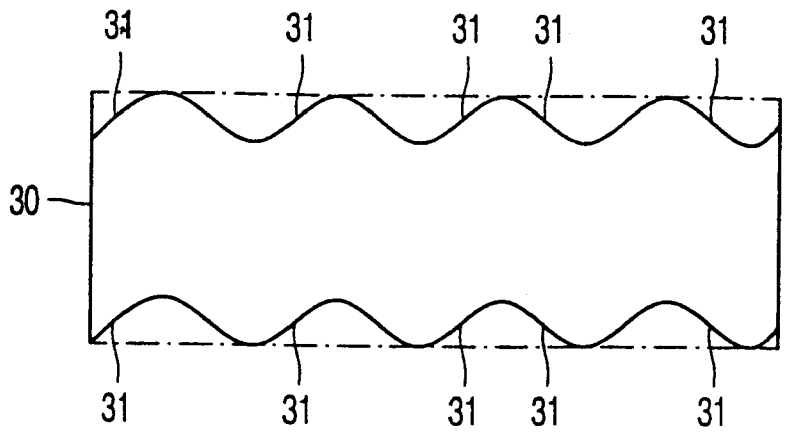
FIG. 3 is a plan view of one of the foils used to form the X-ray filter.
Figure 4:
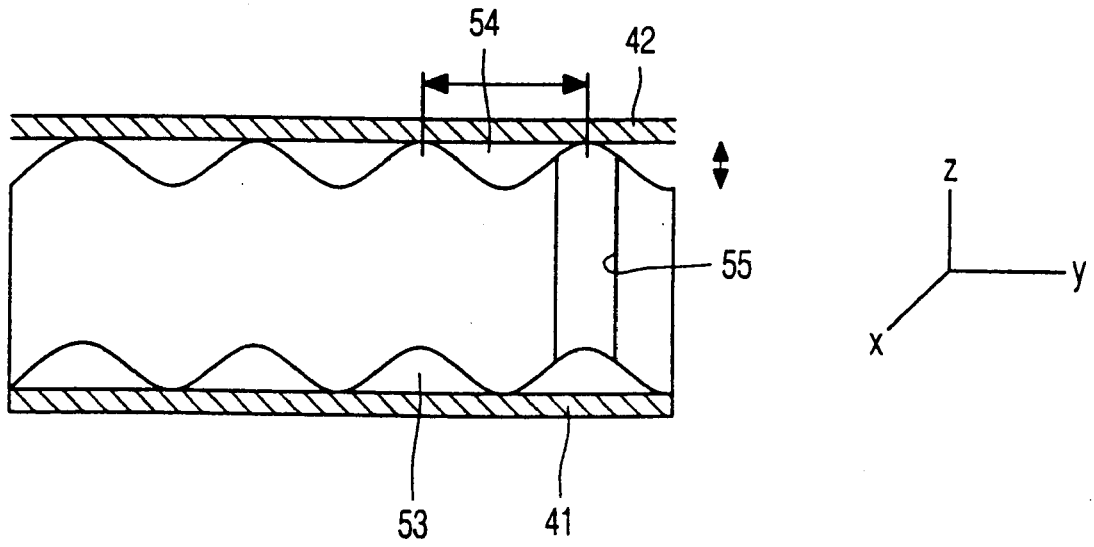
FIG. 4 is a first sectional view of the X-ray filter.

In order to provide the X-ray filter 5 with the sub-ducts, an additional step is executed during the manufacture of the X-ray filter. This step will be described in detail with reference to FIG. 3. FIG. 3 is a plan view of a single foil of a stack of foils wherefrom a honeycomb structure is formed. A honeycomb structure of this kind constitutes a bundle of capillary tubes of the X-ray filter 5. The manufacture of such a honeycomb structure is described, for example in the not previously published European patent application 98203986.9. the honeycomb structure is obtained by stretching the stack of foils which are bonded to one another in bonding locations, for example by thermal compression, in order to realize the honeycomb structure in the stretched state. In order to form the sub-ducts, for example the method is extended with a step for forming cut-outs 31 along oppositely situated edges of the foil 30. The cut-outs can be made by locally removing material. To this end, for example a number of foils 30 are stacked and the cut-outs are provided in the oppositely situated edges, for example by means of punching. The cut-outs are then formed in one step and are aligned with respect to one another. The cut-outs 31 may have a rectangular or circular shape. The spacing, the width and the depth of the cut-outs are preferably chosen to be such that they enable an adequate transport flow of liquid and/or air. Preferably, the width of the sub-duct is chosen to be such that the sub-ducts connect three neighboring capillary tubes. For example, if the diameter of a capillary duct amounts to 350 micrometers, the maximum width of the sub-ducts 700 amounts to 700 micrometers and the minimum width of the sub-ducts to 175 micrometers. Subsequently, a stack of such foils 30 is formed and bonded together in the bonding locations. Such a stack constitutes the honeycomb in the stretched state. FIG. 4 shows a first cross-section of an X-ray filter which includes a first plate 41 and a second plate 42. In order to form the tubes, the two plates 41, 42 are provided on the respective sides of the stack of foils in which the cut-outs 30 have been formed. FIG. 4 also shows a co-ordinate system x, y, z. The sub-ducts 53, 54 extend in the x direction and are arranged adjacent one another in the y direction. The capillary tubes, a capillary 55 of which is shown in FIG. 4, are directed in parallel in the z direction and the stack of foils extends in the x direction of the co-ordinate system. The sectional view of the X-ray filter as shown in FIG. 4 has been taken along an y, z plane.

Another possibility consists in forming the sub-ducts 53, 54 in the plates 41, 42. To this end, a side of the plates 41, 42 which faces the stack of foils is provided with slots with a spacing which equals the diameter of a capillary tube, said slots following the shape of the stretched foils of the honeycomb structure of the X-ray filter. The depth of such slots amounts to, for example 0.5 mm. The maximum width of such slots amounts to 700 micrometers for a capillary tube having a diameter of, for example 350 micrometers. An advantage of the use of slots in the plates consists in that the direction of the sub-ducts 53, 55 can be chosen at will in a plane perpendicular to the foils.

Figure 5:
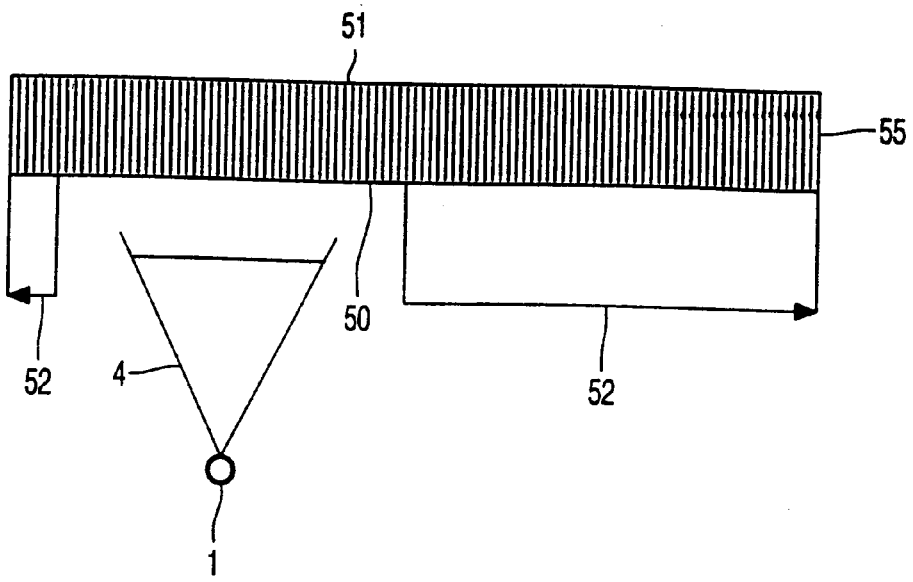
FIG. 5 is a second sectional view of the X-ray filter.
Figure 6:
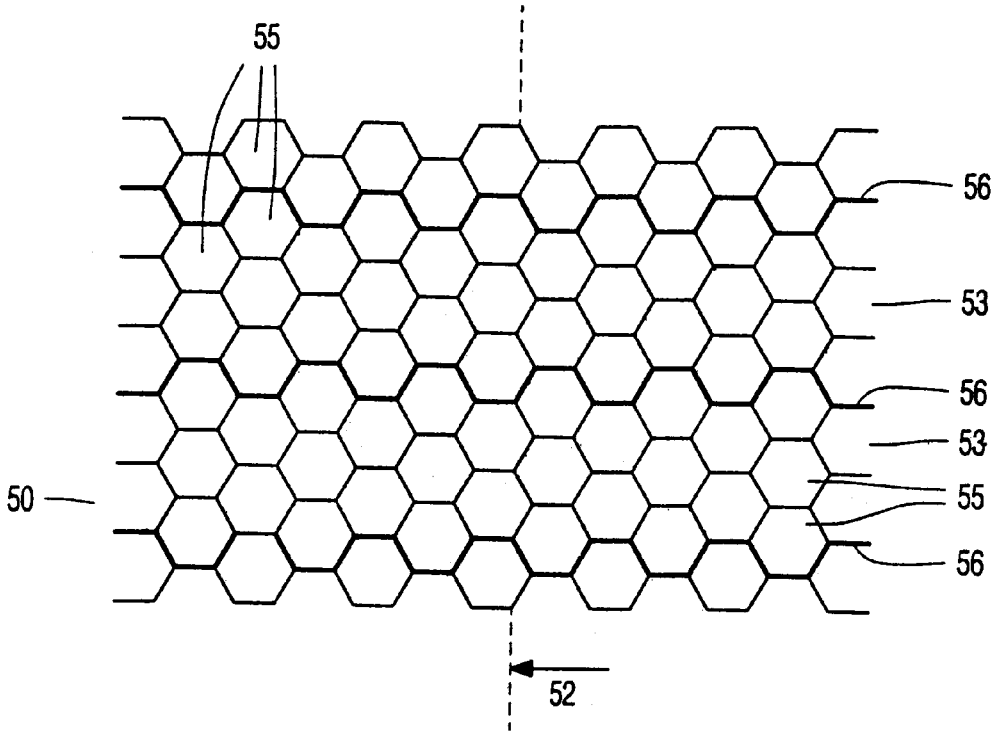
FIG. 6 is a third sectional view of the X-ray filter.

The reservoir containing the X-ray absorbing liquid is preferably integrated in the X-ray filter 5 by providing the X-ray filter with additional capillary tubes 55 which are situated outside the part of the X-ray filter which is traversed by the X-ray beam 4 to be generated. The number of capillary tubes is then increased to, for example 256×128. FIG. 5 shows a cross-section of such an X-ray filter with the reservoir which has been taken in the y, z plane. FIG. 5 shows the sub-ducts 50, 51 and the reservoir 52. The sub-duct 50, for example, each time connects three adjacently situated capillary tubes 55 to one another over the entire length of a first side of the X-ray filter. The sub-duct 51 interconnects, for example, each time three adjacently situated capillary tubes 55 over the entire length of a second side of the X-ray filter which lies opposite the first side. FIG. 6 shows a part of a cross-section of the X-ray filter, taken along the x, y plane, and also shows the reservoir 52 which includes chambers 53. In order to counteract an excessively uneven pressure distribution in the sub-ducts 50 of the X-ray filter, the reservoir 52 is preferably subdivided into the chambers 53. The number of chambers in practice amounts to, for example 42. A chamber 53 of this kind contains several capillary tubes 55. The chambers 53 are separated by the walls 56 of the outer capillary tubes 33. FIG. 6 shows the walls 56 whereby the chambers 53 are separated. The sub-duct 50 also connects the chamber 53 to the capillary tubes 55 which are situated in the X-ray beam 4 to be generated, each chamber 53 preferably being connected to a respective sub-duct 50.

The X-ray examination apparatus also includes means 25 for generating a signal which represents an angle of inclination between a longitudinal axis of the sub-ducts and the horizontal plane. Means of this kind are provided with, for example an inclinometer which is independent of a rolling motion. Such an inclinometer is insensitive to a rolling motion about the axis with respect to which the inclination relative to the horizontal plane is determined. According to the invention the axis of the inclinometer 23 which is insusceptible to a rolling motion is arranged so as to be parallel to the sub-ducts. Inclinometers of this kind are known per se, for example from the published British patent application GB 2 273 356. When such an inclinometer is inserted in, for example a Wheatstone bridge, a signal 27 representing the angle of inclination can be generated. The signal 27 is applied to the microcomputer 28. The microcomputer, provided with a suitable program, generates the control signals 28 for the electrically controllable drive, for example a second electric motor with a mechanical transmission 26 for rotating the X-ray filter 5 in such a manner that the angle of inclination is adjusted back to zero degrees and the sub-ducts in the X-ray filter 5 are oriented horizontally. Other types of inclinometer may also be used, for example inclinometers of the optical type as known from U.S. Pat. No. 5,425,179, or of the inductive type as known inter alia from U.S. Pat. 5,703,484.

In order to compensate the effect of pressure differences in the sub-ducts on the transport from and to the capillary tubes 55, use can also be made of a compensation voltage which is added to the control voltage in order to adjust the quantity of X-ray absorbing liquid in the capillary tubes 55 of the X-ray filter. To this end, the X-ray examination apparatus includes means for generating the compensation voltage. Such a means include, for example a second roll-independent inclinometer 29 which is inserted, for example in a second Wheatstone bridge which generates a second signal 70 which is applied to the microcomputer 28. The microcomputer is also provided with a program for determining the compensation voltage 71 from the second signal 70. This compensation voltage 71 is subsequently applied to the electrical adjusting unit 7 which adds the compensation voltage to the control voltage. In practice it is thus possible to compensate hydrostatic pressure differences due to, for example three capillary tubes which are situated one above the other. A maximum value of such a compensation voltage can be determined experimentally. A value of the compensation voltage 71 to be adjusted is dependent on the orientation of the X-ray filter. The compensation voltage is proportional to $\sin\Theta$, where $\Theta$ represents an angle between the longitudinal axis of one of the sub-ducts and a vertical plane.

What is claimed is:

1. An X-ray examination apparatus for forming X-ray images of an object, which apparatus includes an X-ray source for generating an X-ray beam, an X-ray filter which is provided with filter elements which are arranged to contain an adjustable quantity of X-ray absorbing liquid in order to adjust an intensity profile on an object, and with a supply duct for connecting the filter elements to a reservoir for the X-ray absorbing liquid, an X-ray detector for receiving a part of the X-ray beam, having traversed the object, in order to detect an X-ray image, characterized in that the supply duct includes sub-ducts, and that each of the sub-ducts connects at least one of the filter elements to the reservoir.

2. An X-ray examination apparatus as claimed in claim 1, in which the sub-ducts are arranged so as to extend parallel to one another.

3. An X-ray examination apparatus as claimed in claim 1, the X-ray examination apparatus being provided with adjusting means for keeping the X-ray source, the X-ray filter and the detector oriented along a first axis and for adjusting an orientation of the first axis relative to a horizontal plane, the X-ray examination apparatus also including means for rotating the X-ray filter about the first axis.

4. An X-ray examination apparatus as claimed in claim 3, in which the means for rotating the X-ray filter include a collimator which accommodates the X-ray filter.

5. An X-ray examination apparatus as claimed in claim 1, which is provided with means for generating a signal which represents an angle of inclination between a longitudinal axis of one of the sub-ducts and a horizontal plane.

6. An X-ray examination apparatus as claimed in claim 5, in which the means for generating the signal representing the angle of inclination include a roll-independent inclinometer.

7. An X-ray examination apparatus as claimed in claim 3, in which the means for rotating the X-ray filter include an electrically controllable drive and the X-ray examination apparatus is provided with control means which are arranged to generate control signals for the electrically controllable drive in order to orient a longitudinal axis of one of the sub-ducts horizontally in dependence on the signal representing the angle of inclination.

8. An X-ray examination apparatus as claimed in claim 1, in which the X-ray filter contains the reservoir which is arranged outside the X-ray beam to be generated, the reservoir containing chambers and each chamber being connected to at least one of the subducts.

9. An X-ray examination apparatus as claimed in claim 1 which is provided with means for generating a control signal whereby the adjustable quantity of X-ray absorbing liquid in the filter elements is adjusted.

10. An X-ray examination apparatus as claimed in claim 9 which is provided with means for generating a compensation signal which is dependent on the orientation of the X-ray filter, and with means for correcting the control signal by way of the compensation signal.

11. An X-ray filter provided with filter elements which are arranged to contain an adjustable quantity of X-ray absorbing liquid in order to adjust an intensity profile on an object, and a supply duct for connecting the filter elements to a reservoir for the X-ray absorbing liquid, characterized in that the supply duct includes sub-ducts, each of which connects at least one of the filter elements to the reservoir.

12. An X-ray filter as claimed in claim 10, which X-ray filter contains the reservoir which includes chambers, each chamber being connected to at least one of the sub-ducts.

* * * * *